US011651872B2

(12) United States Patent
Lynch

(10) Patent No.: US 11,651,872 B2
(45) Date of Patent: May 16, 2023

(54) INSERTABLE PIN FOR HIGH VOLTAGE INSULATING COVERS

(71) Applicant: Eco Electrical Systems, Reno, NV (US)

(72) Inventor: Michael Lynch, Reno, NV (US)

(73) Assignee: Eco Electrical Systems, Inc., Reno, NV (US)

( * ) Notice: Subject to any disclaimer, the term of this patent is extended or adjusted under 35 U.S.C. 154(b) by 155 days.

(21) Appl. No.: 17/191,396

(22) Filed: Mar. 3, 2021

(65) Prior Publication Data

US 2022/0285053 A1 Sep. 8, 2022

(51) Int. Cl.
*H01B 17/22* (2006.01)
*H01H 85/165* (2006.01)
*H01H 85/042* (2006.01)

(52) U.S. Cl.
CPC ..... *H01B 17/22* (2013.01); *H01H 85/165* (2013.01); *H01H 85/042* (2013.01); *H01H 2223/044* (2013.01)

(58) Field of Classification Search
CPC .... H01B 17/22; H01H 85/165; H01H 85/042; H01H 31/00; H02G 15/113; H02G 1/02; H02G 3/08
USPC ..... 174/110 R
See application file for complete search history.

(56) References Cited

U.S. PATENT DOCUMENTS 9,102,043 B2 * 8/2015 Morin ..... B25B 31/00
2011/0192627 A1 * 8/2011 Niles ..... H02G 7/00 174/50
2013/0264097 A1 * 10/2013 Lynch ..... H02G 7/05 174/168

* cited by examiner

*Primary Examiner* — Edwin A. Leon
*Assistant Examiner* — Iman Malakooti
(74) *Attorney, Agent, or Firm* — Patent Law Group; Brian Ogonowsky

(57) ABSTRACT

A plastic retaining pin for being inserted through a retaining hole in a high voltage insulating cover has a compressible nose, with the wide part of the nose being larger than the retaining hole. The pin may be on the order of 3-12 inches long. The other end of the pin has a grasping ring for receiving the hook of a hot stick. Along the length of the body of the pin is a plurality of radial portions (e.g., six or more) extending outward from a centerline of the body. These radial portions may be skirts or ribs having a diameter less than the retaining hole in the cover. The skirts or ribs greatly increase the surface leakage distance along the body of the pin and also prevent conductive liquids flowing along the body, which may lead to a flashover.

17 Claims, 6 Drawing Sheets

INSERTABLE PIN FOR HIGH VOLTAGE INSULATING COVERS

FIELD OF THE INVENTION

The invention relates to a dielectric retaining pin, installable using a hot stick, for retaining a dielectric cover over a high voltage fuse cutout or for retaining other covers over other high voltage components, where the cover protects birds and other animals from electrocution.

BACKGROUND

Applicant's own U.S. Pat. No. 10,679,815, incorporated herein by reference, describes a dielectric cutout cover held in place using dielectric retaining pins. The cover protects birds and other animals from electrocution, which may trigger an over-current condition that causes a power outage.

The present disclosure relates to improvements in the retaining pins, and descriptions of their use are presented to fully understand their function in improving the overall insulating properties of the resulting cover.

FIG. 1 illustrates a conventional fuse cutout 10. A mounting bracket 12 secures a ceramic or polymer insulator 14 to a wooden utility pole or cross-arm used to support high voltage conductors, such as carrying 3-phase 12 KVAC or higher. A "hot" wire 16 is attached to one phase. A metal connector 18 electrically connects to the wire 16 to a top contact 20 of a blowable fuse 22. The fuse 22 electrically connects to a pivot joint 24 and a bottom connector 26. The bottom connector 26 is connected to another wire (not shown) which may lead to a transformer or any other electrical device or conductor. Opening or blowing of the fuse 22 disconnects the top contact 20 from the bottom connector 26.

A metal hook assembly 28 is fixed to the connector 18 and is used to temporarily support a loadbreak tool for opening the fuse 22. The bent hook assembly 28 is better shown in FIGS. 7 and 8. A metal pull ring 30 is physically and electrically connected to the upper end of the fuse 22. The pull ring 30 always faces away from the pole or cross-arm.

The loadbreak tool has a metal hook that engages the pull ring 30 to allow the linemen to open the fuse 22 when the wire 16 is energized. The loadbreak tool also engages the metal hook assembly 28. The loadbreak tool includes a spring-loaded switch that rapidly opens up the circuit to prevent an arc forming after the fuse 22 is pulled away from the top contact 20.

FIG. 2 illustrates a dielectric cover 32 previously invented by the Applicant. The cover 32 also represents a similar design of other commercially available cutout covers that have a slot 34 in the back for placing the cover 32 over the cutout 10, and removing the cover 32 from the cutout 10, while the energized wire 16 is connected. In some covers, the slot may resiliently close after the wire 16 passes through.

The cover 32 covers the top and sides of the cutout 10, including partially surrounding the metal hook assembly 28 and the pull ring 30 on their lateral sides. A flared-out portion 36 of the cover 32 is intended to allow easy access to the hook assembly 28 and pull ring 30 by the loadbreak tool.

The cover 32 has through-holes 38, 39, and 40. Depending on the type of insulator used, porcelain or polymer, one retaining pin is inserted through one hole (and its opposite hole) and another identical retaining pin is inserted through one of the remaining holes, such as by using a hot stick. The pins go below the cutout's metal connector 18 and top contact 20 to prevent the cover 32 being blown off the cutout. The same retaining technique may be used for any other type of cover for high voltage components to protect wildlife from electrocution.

FIGS. 3 and 4 are two views of a retaining pin 44, described in Applicant's U.S. Pat. No. 8,963,011, incorporated herein by reference. The pin 44 has a ring 46 that engages a hook on a hot stick. At the other end of the pin 44 is a resilient portion 48 (a nose) with a narrow tip that expands outward at about a 15 degree angle. The resilient portion 48 allows the pin 44 to be inserted easily through the cover's holes 38-40 by the hot stick, but the top of the resilient portion 48 has a 45 degree angle, which makes it much more difficult to remove the pin 44. A cross-section of the body 49 of the pin 44 is smooth and slightly oval. The pin 4 is formed of a polymer. Identical pins 44 extend below the metal connector 18 and the top contact 20 so the cover 32 does not blow off in high winds.

The pins 44 and cover 32 have been used in the field, and a flashover problem has been discovered in rare instances. Such a flashover incurs a substantial expense since a lineman must replace a fuse. The flashover issue was presented by the utilities company to the Applicant for analysis. The Applicant has concluded that the flashover was due to liquid running along the smooth body 49 of the pin 44 and creating a low resistance path between a high voltage component and a roosting bird. The bird may have been roosting on the cover 32 and contacted (or came close to) a ground or a different phase. The low resistance path between the ring 46 (on the outside of the cover) and the portion of the pin 44 closest to the high voltage components likely caused an arc between the bird (roosting on the cover 32) and the nearest grounded structure, such as a metal or wooden support structure. The liquid running along the pin's smooth body 49 in one case was due to a bird defecting on the pin 44 while perhaps perching on the cover 32. Bird droppings contain a relatively high concentration of salt, which causes the liquid to be conductive. Alternatively, rain or snow may be the cause of the liquid running along the pin 44.

What is needed is an improvement to the prior art cover and pin assembly that prevents flashovers due to conductive liquid running along the body of the pin 44.

SUMMARY

A dielectric cover over high voltage components, such as for protecting wildlife from electrocution, is held in place over the components by dielectric pins that extend through holes in the cover, where the pins are manipulated by a loadbreak tool or hot stick. The pins vary in length depending on the voltage requirements of the cover and the size of the various components. A higher voltage requirement typically increases the size of the high voltage components and the size of the cover. The pins may vary between 3-12 inches in length.

Instead of the pin having a smooth body, the pin has a plurality (e.g., six or more) of circular ribs or skirts radially extending outward along the pin's body that greatly increase the surface leakage distance between the "outside" ring 46 of the pin and the area of the pin closest to the high voltage components under the cover. The ribs/skirts also prevent any liquid from being drawn along the body of the pin such as by gravity or capillary action. Thus, flashovers by bird droppings or contaminated water on the pins are prevented.

The ribs/skirts have a diameter smaller than the cover's through-holes so do not interfere with insertion or removal of the pin. Since the pins are injection molded, the ribs/skirts do not add any cost to the pins, yet provide a valuable advantage over the prior art pins.

In one embodiment, the pin's body is oval, so the skirts and ribs are also oval. The cover's holes may also be oval, so the pin is oriented in a particular way when inserted through the holes. The ring is perpendicular to the wide dimension of the oval, so the orientation causes the ring to be parallel with the ground for optimal engagement with the hot stick.

BRIEF DESCRIPTION OF THE DRAWINGS

Elements labeled with the same numerals in the various figures may be identical or similar.

DETAILED DESCRIPTION

Figure 5:
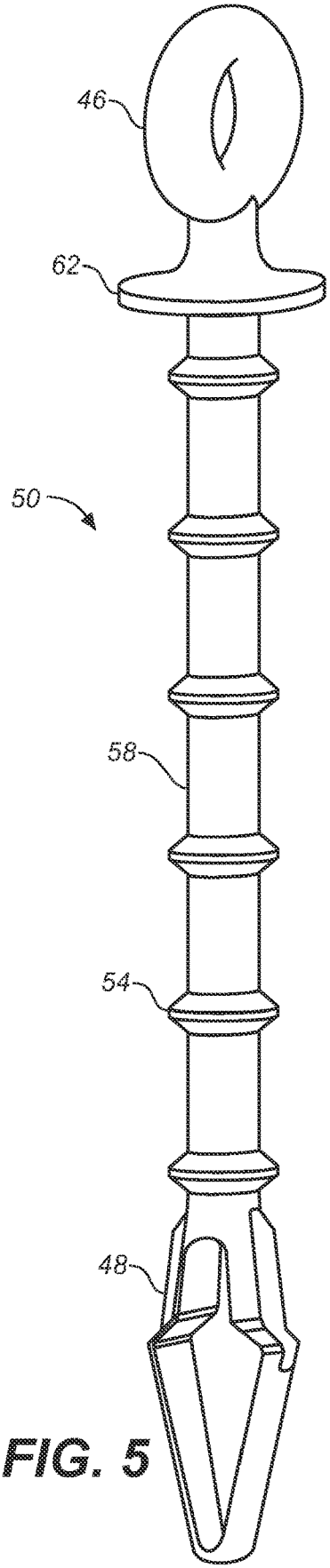
FIG. 5 is a perspective view of a dielectric retaining pin, in accordance with one embodiment of the invention, where concentric skirts (tapering outward) are distributed along the body of the pin.
Figure 6:
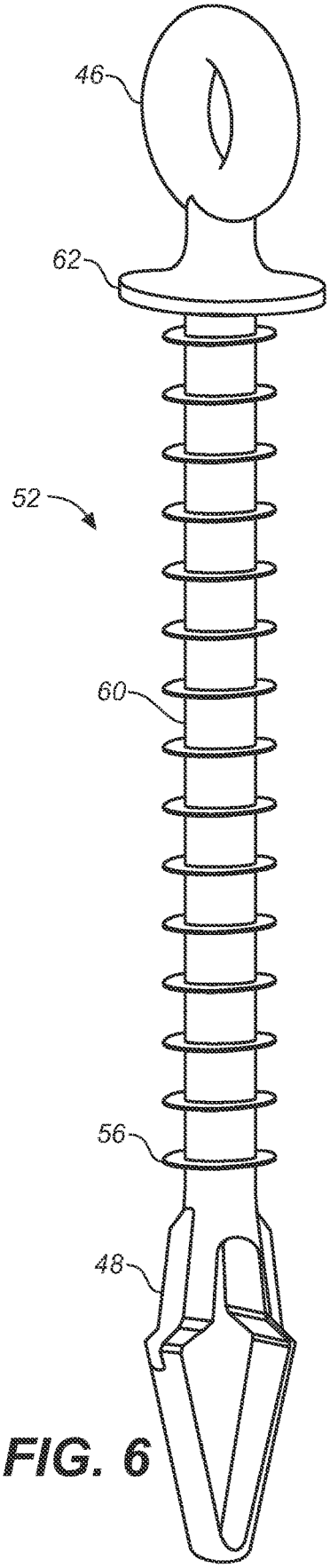
FIG. 6 is a perspective view of a dielectric retaining pin, in accordance with another embodiment of the invention, where concentric ribs (generally constant thickness) are distributed along the body of the pin.

FIGS. 5 and 6 illustrate dielectric retaining pins 50 and 52 that are used to secure dielectric covers over high voltage components. The covers may be cutout covers, covers over insulators supporting wires, or any other type of insulating cover, typically for protecting wildlife from electrocution.

In one embodiment, the pins 50 and 52 are about 4 inches long, and the drawings have generally accurate relative dimensions. The pins 50 and 52 are an injection molded polymer.

Figure 3:
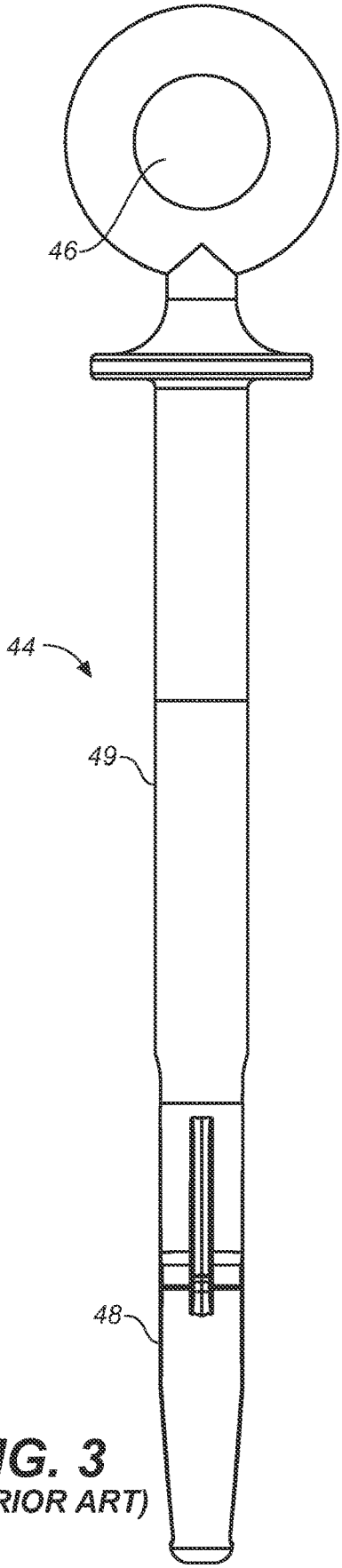
FIG. 3 (PRIOR ART)
FIG. 3 is a front view and FIG. 4 is a side view of an oval-shaped pin used to secure the cover over the cutout.
Figure 4:
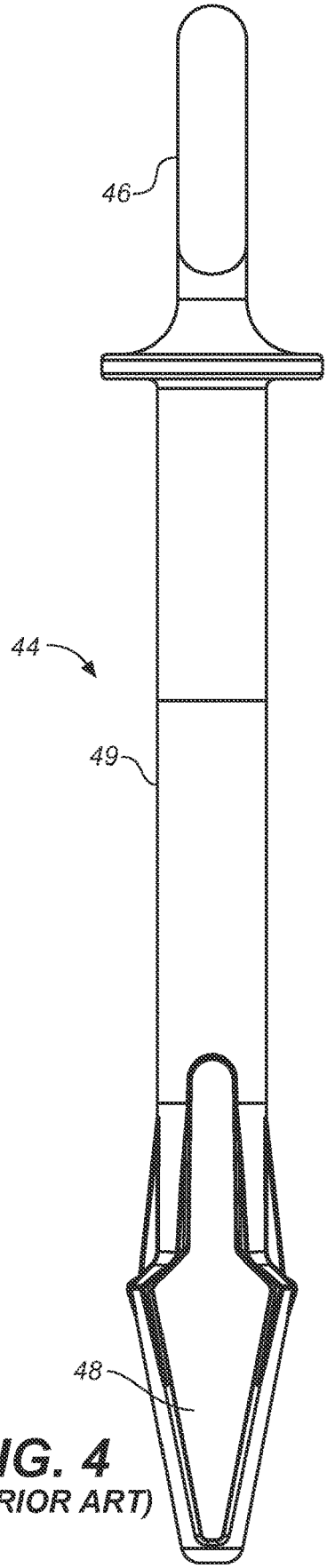
FIG. 4 (PRIOR ART)

The performance of the pins 50 and 52 is exactly like the pin 44 in FIGS. 3 and 4. The only difference is the skirts 54 in FIG. 3 and the ribs 56 in FIG. 6 along the body 58 or 60.

Figure 1:
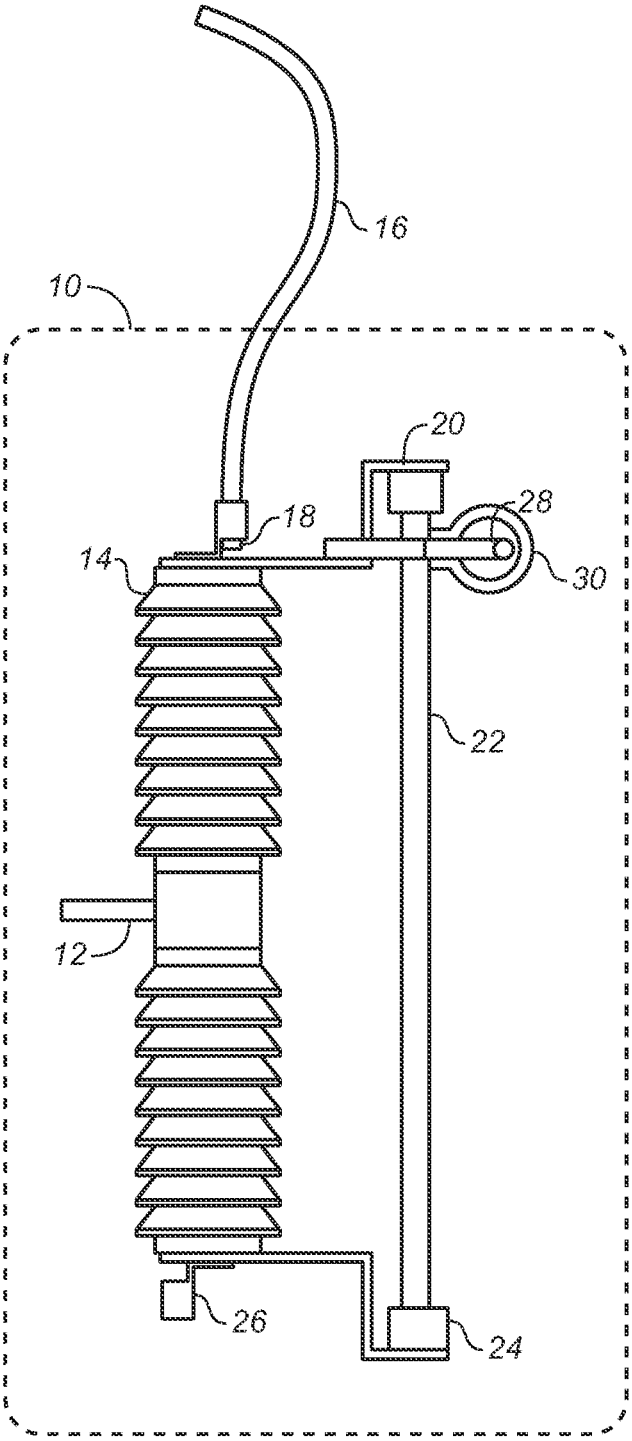
FIG. 1 (PRIOR ART)
FIG. 1 is a side view of a conventional fuse cutout disclosed in Applicant's U.S. Pat. No. 10,679,815.
Figure 2:
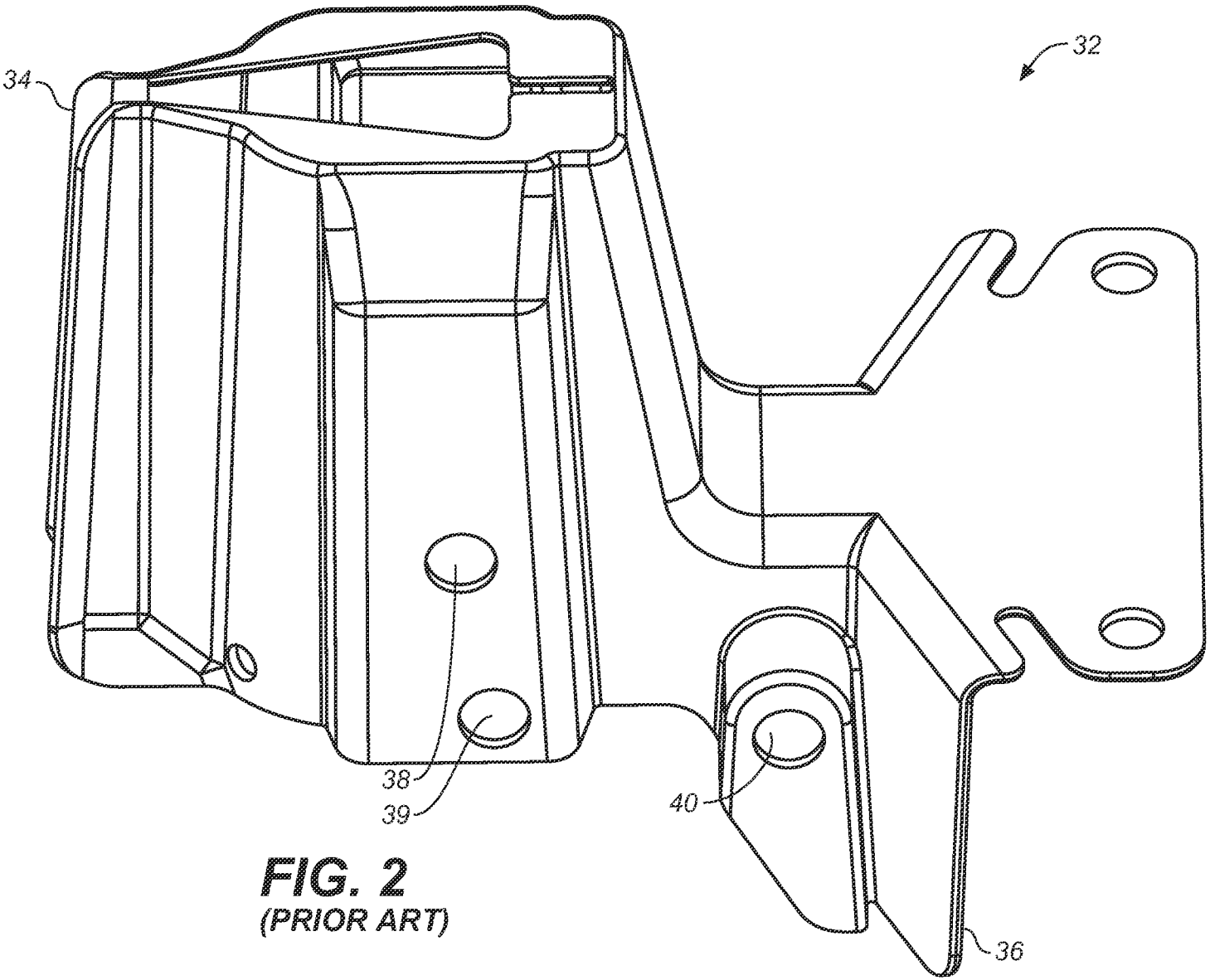
FIG. 2 (PRIOR ART)
FIG. 2 is a perspective view of a prior art cutout cover that fits over the cutout and is held in place by retaining pins.
Figure 7:
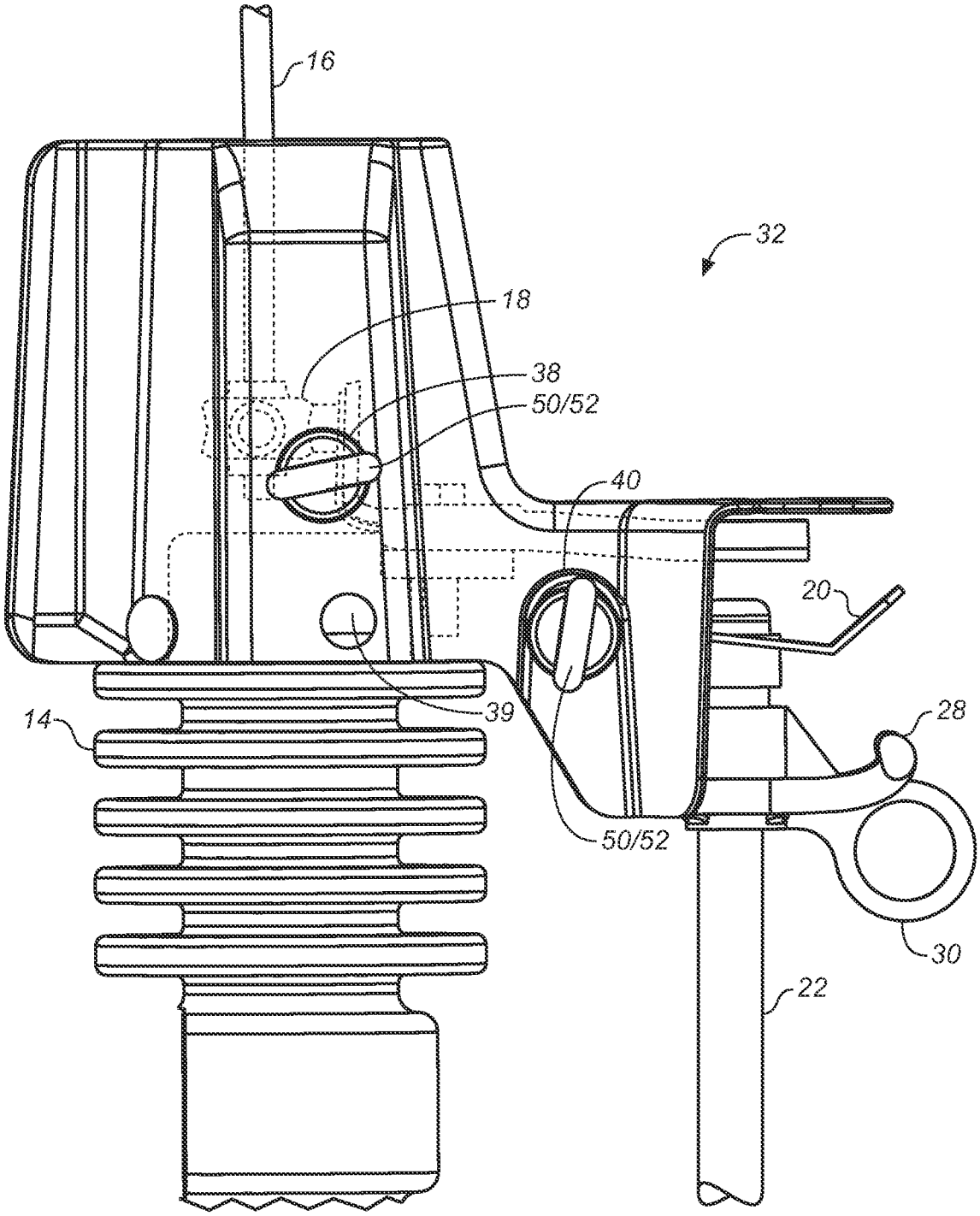
FIG. 7 is a semi-transparent side view of the cutout cover of FIG. 2 being retained in place using the pin of FIG. 5 or 6. The cutout is using a relatively thick porcelain insulator, and one of the pins is inserted through a top set of holes that is not blocked by the insulator.

In FIG. 7, the pin 50 or 52 is inserted through the cover's holes 38 and 40 (FIGS. 2 and 7) until the expanded portion 62 of the pin 50 or 52 abuts the cover 32. The expanded portion 62 provides one level of prevention of liquids entering the cover 32 via the pin 50 or 52.

In the event there is a gap between the pin 50/52 and the cover, allowing a liquid to enter the cover 32 via the pin 50/52, the skirts 54 or ribs 56 not only block the liquid from running along the body 58/60 but add a significant surface leakage distance along the body 58/60. This greatly increases the flashover voltage and the insulating properties of the cover assembly in high moisture conditions.

In FIG. 7, the insulator 14 is a porcelain (ceramic) type, which is relatively thick. As such, the hole 39 is blocked by the insulator 14. However, holes 38 and 40 are not blocked, so the pin 50/52 is inserted through those holes 38/40 and below the metal connector 18 and top contact 20 of the cutout to keep the cover 32 in place during high winds.

Figure 8:
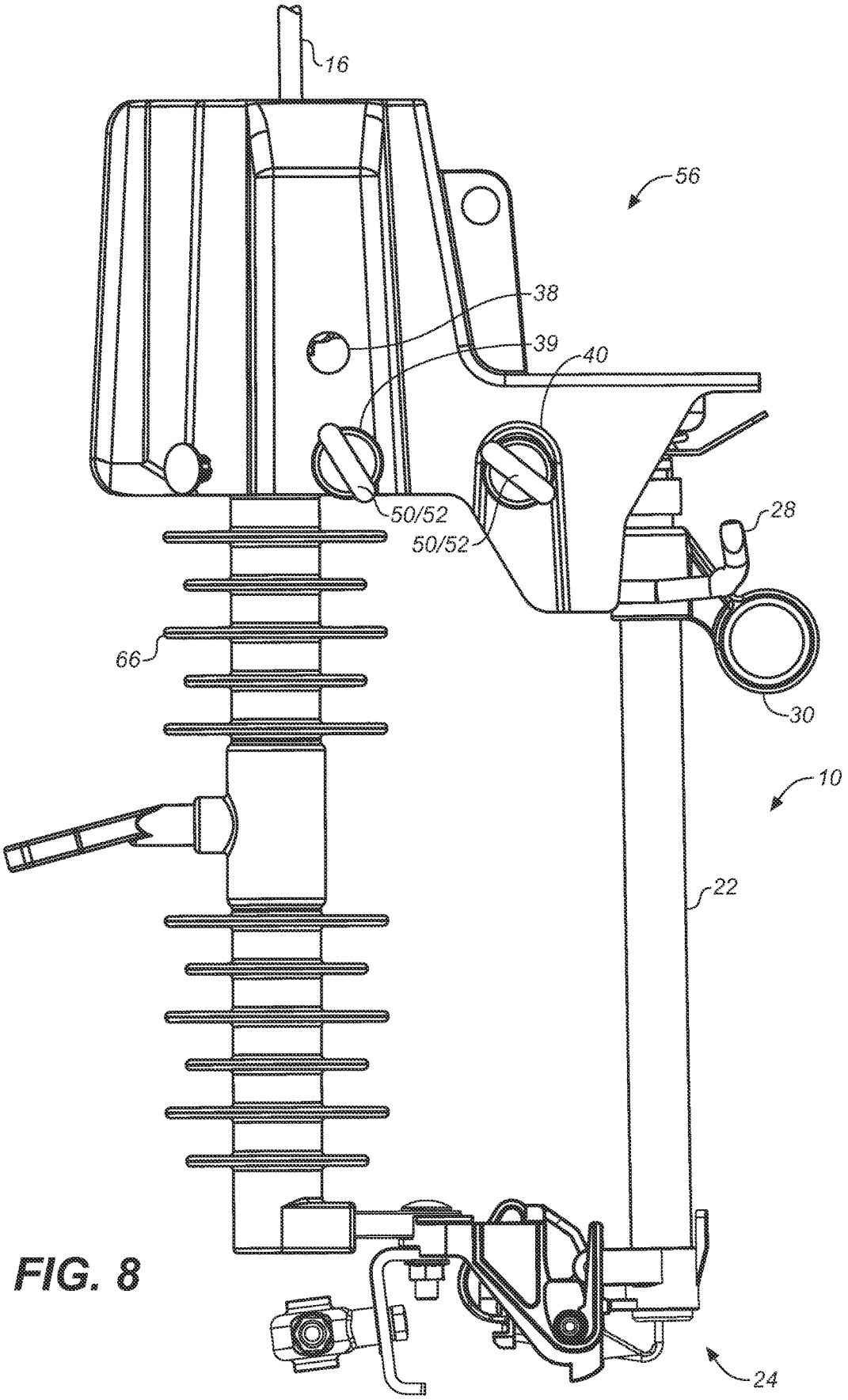
FIG. 8 is a side view of a cutout cover, similar to that of FIG. 2, being retained in place using the pin of FIG. 5 or 6. The cutout is using a relatively thin polymer insulator, and one of the pins is inserted through a bottom set of holes that is not blocked by the insulator.

FIG. 8 shows the use of a similar cover 56 over a polymer insulator 66 that is narrower than the porcelain insulator 14 of FIG. 7. Pin 50 or 52 is inserted through holes 39 and 40 since the hole 39 is not blocked by the narrower insulator 66. If the hole 38 is not blocked, a pin 50/52 can instead be inserted through the hole 38. The pins 50/52 prevent the cover 32 being blown off in high winds.

The pin 50/52 can be used with many other types of dielectric covers that are used to protect wildlife from high voltage components. Such other covers include covers that are secured over an insulator supporting a wire, or covers over bushings for transformers, switches, etc.

Instead of the skirts 54 and ribs 56 shown, other types of designs may be used to increase the surface leakage distance along the pin's body.

In the example of FIG. 5, six skirts 54 are shown but any number of skirts can be used, as required.

Similarly, in the example of FIG. 6, fifteen ribs 56 are shown but any number of ribs can be used, as required.

In one example, the body 58/60 of the pin 50/52 has a diameter of about one-quarter inch, and the skirt 54 or rib 56 radially extends about 1/16-1/8 out of the body 58/60.

The body 58/60 may be oval shaped, which means the skirts 54 and ribs 56 are also oval shaped. The holes in the cover 32 may be similarly oval shaped, and the pin 50/52 is oriented so the oval shapes are aligned. This also prevents the pin 50.52 from rotating after being inserted into the hole. The ring 46 is perpendicular to the wide diameter of the oval, so the ring 46 is generally parallel to the ground when the cover 32 and pin 50/52 are properly installed. This is an optimal angle for grasping the ring 46 with a hot stick. The resilient portion 48 of the pin 50/52 aligns with the wide part of the oval and is perpendicular to the ring 46.

Any diameter the skirts 54 or ribs 56 may be adequate, depending on the moisture level. The skirts 54 or ribs 56 can instead take other forms of a plurality of radial portions extending outward from a centerline of the body 58/60 between the resilient portion 48 (the nose) and the grasping ring 46. The radial portions have a diameter that is smaller than the holes in the cover 32.

The pins 50/52 are inserted and removed via a hot stick to allow the cover 32 to be installed or removed while the conductor 16 is energized.

Other embodiments of pins are envisioned. For example, in some uses, the pins do not require the resilient ends to prevent the pins being unintentionally dislodged from the cover. In one embodiment, the pin 50/52 does not need to be pushed all the way through the cover 32, since pushing the pin only partially through the cover 32 will still secure the cover 32 over the cutout.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is claimed is:

1. A system for use in high voltage applications comprising:

an insulating structure covering a conductor, the insulating structure having a retaining hole; and a retaining pin formed of an insulating material, the retaining pin being inserted through the retaining hole to prevent the insulating structure being inadvertently removed from over the conductor, the retaining pin having a grasping ring at one end configured for receiving a tool at an end of a hot stick for inserting the pin in the retaining hole and removing the pin from the retaining hole, the retaining pin having a nose at its other end, the nose being resiliently collapsible upon a compressive pressure being applied to the nose, a maximum width of the nose being greater than a diameter of the retaining hole, so that the retaining pin is secured in place within the retaining hole by the resilient nose; and the retaining pin having a body extending between the nose and the grasping ring, the body having a plurality of radial portions along its length extending outward from a centerline of the body, the radial portions extending completely around the body, wherein a diameter of the radial portions is less than a diameter of the retaining hole of the insulating structure.

2. The system of claim 1 wherein the plurality of radial portions comprises a plurality of circular ribs.

3. The system of claim 1 wherein the plurality of radial portions comprises a plurality of circular skirts having sides that taper away from the centerline of the body.

4. The system of claim 1 wherein there are at least two radial portions between the nose and the ring.

5. The system of claim 1 wherein there are at least six radial portions between the nose and the ring.

6. The system of claim 1 wherein the insulating structure at least partially covers a wire conducting a voltage.

7. The system of claim 1 wherein there are a plurality of retaining holes in the insulating structure for receiving a plurality of retaining pins.

8. The system of claim 1 wherein the pin is located below the conductor.

9. The system of claim 1 wherein the body and the radial portions are one of circular or oval.

10. A device for retaining an insulating structure over a conductor in high voltage applications, the insulating cover having a retaining hole, the device comprising:

a retaining pin formed of an insulating material, the retaining pin being configured to be inserted through the retaining hole to prevent the insulating structure being inadvertently removed from over the conductor, the retaining pin having a grasping ring at one end configured for receiving a tool at an end of a hot stick for inserting the pin in the retaining hole and removing the pin from the retaining hole, the retaining pin having a nose at its other end, the nose being resiliently collapsible upon a compressive pressure being applied to the nose, a maximum width of the nose being greater than a diameter of the retaining hole, so that the retaining pin is secured in place within the retaining hole by the resilient nose; and the retaining pin having a body extending between the nose and the grasping ring, the body having a plurality of radial portions along its length extending outward from a centerline of the body, the radial portions extending completely around the body, wherein a diameter of the radial portions is less than a diameter of the retaining hole of the insulating structure.

11. The device of claim 10 wherein the plurality of radial portions comprises a plurality of circular ribs.

12. The device of claim 10 wherein the plurality of radial portions comprises a plurality of circular skirts having sides that taper away from the centerline of the body.

13. The device of claim 10 wherein there are at least two radial portions between the nose and the ring.

14. The device of claim 10 wherein there are at least six radial portions between the nose and the ring.

15. The device of claim 10 wherein the insulating structure at least partially covers a wire conducting a voltage.

16. The device of claim 10 wherein there are a plurality of retaining holes in the insulating structure for receiving a plurality of retaining pins.

17. The device of claim 10 wherein the body and the radial portions are one of circular or oval.

* * * * *